US006048368A

United States Patent [19]

Tcheou et al.

[11] Patent Number: 6,048,368

[45] Date of Patent: Apr. 11, 2000

[54] CLEANING METHOD FOR TEXTILE FABRICS

[75] Inventors: Eric Tcheou, Brussels; Jose Luis Vega, Strombeek-Bever, both of Belgium

[73] Assignee: The Proctor & Gamble Company, Cincinnati, Ohio

[21] Appl. No.: 09/077,284

[22] PCT Filed: Nov. 27, 1996

[86] PCT No.: PCT/US96/19171

§ 371 Date: May 27, 1998

§ 102(e) Date: May 27, 1998

[87] PCT Pub. No.: WO97/20099

PCT Pub. Date: Jun. 5, 1997

[30] Foreign Application Priority Data

Nov. 27, 1995 [EP] European Pat. Off. ..... 95118617
Sep. 16, 1996 [WO] WIPO ..... PCT/US96/14821

[51] Int. Cl.[7] ..... D06L 1/00; D06L 1/02; D06B 1/00; D06B 9/00

[52] U.S. Cl. ..... 8/137; 8/142; 510/276; 510/281; 510/282; 510/283; 510/285; 510/338; 510/342

[58] Field of Search ..... 8/137, 142; 510/276, 510/278, 280–283, 337–338, 342, 285

[56] References Cited

U.S. PATENT DOCUMENTS

| | | | |
|---|---|---|---|
| 3,748,268 | 7/1973 | Loudas | 252/90 |
| 3,827,857 | 8/1974 | Boulus | 8/137 |
| 4,336,024 | 6/1982 | Denissenko et al. | 8/142 |
| 5,002,684 | 3/1991 | Beck et al. | 8/137 |

FOREIGN PATENT DOCUMENTS

| | | | |
|---|---|---|---|
| 43 03 454 A1 | 8/1994 | Germany | A47L 25/08 |

*Primary Examiner*—Mark Kopec
*Assistant Examiner*—Brian P. Mruk
*Attorney, Agent, or Firm*—C. Brant Cook; Kim William Zerby; Jacobus C. Rasser

[57] ABSTRACT

The present invention provides a more effective method of treating a spot or stain on a textile fabric, the method comprising the steps of: applying a detergent composition to the spot or stain; placing an absorbent layer adjacent to one side of the textile fabric in the region of the spot or stain; and applying heat, pressure, or heat and pressure, to the opposing side of the textile fabric in the region of the spot or stain, preferably in the presence of a hydrophilic solvent, or water, so that some or all of the spot or stain is absorbed into the absorbent layer. The detergent composition can be applied to the textile fabric using a container having a cap to which a foam pad is secured. The cap has a small opening through which the detergent composition can pass.

6 Claims, 4 Drawing Sheets

CLEANING METHOD FOR TEXTILE FABRICS

The present invention relates to a method of removing spots and stains from textile fabrics.

Some stains are not always effectively removed by conventional laundry cleaning processes, for example in a washing machine. Such stains may be more effectively removed by pre-treatment, which herein means a cleaning treatment carried out before the conventional laundry cleaning process; and/or by post-treatment, which herein means a cleaning treatment carried out after the conventional laundry cleaning process. The present invention is concerned with a post-treatment cleaning method.

EP200807, published on Nov. 12, 1986, discloses an iron intended for cleaning clothes during ironing, i.e. a post-treatment. To achieve this objective the housing of the iron can be adapted with a recess to receive a brush (page 3, line 22 to page 4, line 1). The iron is also provided with vacuum cleaning means. There is no suggestion that cleaning compositions could be used to enhance the cleaning method.

U.S. Pat. No. 3,748,268, published on Jul. 24, 1973, discloses spot and stain removing detergent compositions. The compositions are intended primarily for cleaning carpets, although textile fabrics are also mentioned The patent suggests that a pre-treatment cleaning method comprising gentle rubbing action may be used to help work the detergent composition into the stain, followed by stain removal using a dry absorbent cloth. Water is then applied to complete the cleaning operation, optionally using an absorbent material to remove the soil and composition remnants.

Many textile fabrics, however, especially those made from silk or wool, are much more delicate than carpets. What may be considered as a gentle rubbing action when applied to a carpet could be considered as a harsh rubbing action when applied to a textile fabric. The very gentle treatment that is acceptable for delicate fabrics, however, may result in incomplete removal of stains.

DE-A-43 03 454, published on Aug. 11, 1994, describes a process for stain removal and a stain removal set. The process comprises the steps of applying a stain remover to a stain which is then activated and washed out with hot water. The hot water is applied by means of heating water in a sponge using a hot iron. This cleaning process results in water being applied to a large area of the fabric, i.e. and area corresponding at least to the area of the sponge, which can result in fresh, greasy stains being spread over the fabric rather than being removed. Furthermore, the presence of the sponge between the fabric and the iron prevents the heat from effectively reaching the region of the spot or stain. Simply applying more heat from the iron results in scorching or melting the sponge.

The object of the present invention is to provide a more effective method of treating a spot or stain on a textile fabric comprising the steps of: applying a detergent composition to the spot or stain; placing an absorbent layer adjacent to one side of the textile fabric in the region of the spot or stain; and applying heat, pressure, or heat and pressure so that some or all of the spot or stain is absorbed into the absorbent layer.

It is a further object of the present invention that the textile fabric should be dry and ready to wear at the end of the cleaning method.

SUMMARY OF THE INVENTION

The object of the invention is achieved by applying the heat and/or pressure to the opposing side of the textile fabric in the region of the spot or stain preferably in the presence of a hydrophilic solvent or water. Without wishing to be bound by theory it is believed that the application of heat and/or pressure improves the cleaning efficiency by modifying the physical characteristics, such as viscosity, which promotes better penetration of the detergent composition into the stain, thereby improving cleaning efficiency. Furthermore the application of heat evaporates any residual water leaving the textile fabric dry.

In a preferred embodiment of the invention a method of treating a spot or stain on a textile fabric is provided comprising the steps of:

(a) applying a detergent composition to the spot or stain and placing an absorbent layer adjacent to the textile fabric in the region of the spot or stain and a first means for transferring some or all of the spot or stain into the absorbent layer; and subsequently (b) applying a hydrophilic solvent, or water, to the textile fabric in the region of the spot or stain and placing an absorbent layer adjacent to the textile fabric in the region of the spot or stain and a second means for transferring some or all of the spot or stain into the absorbent layer.

The second means for transferring the stain to the absorbent layer is preferably by applying heat, more preferably by using a hand-held domestic iron. The first means for transferring some or all of the spot or stain, preferably comprises the step of rubbing, pressing or brushing the spot or stain.

DETAILED DESCRIPTION OF THE INVENTION

Figures 1, 2, 3, 4:
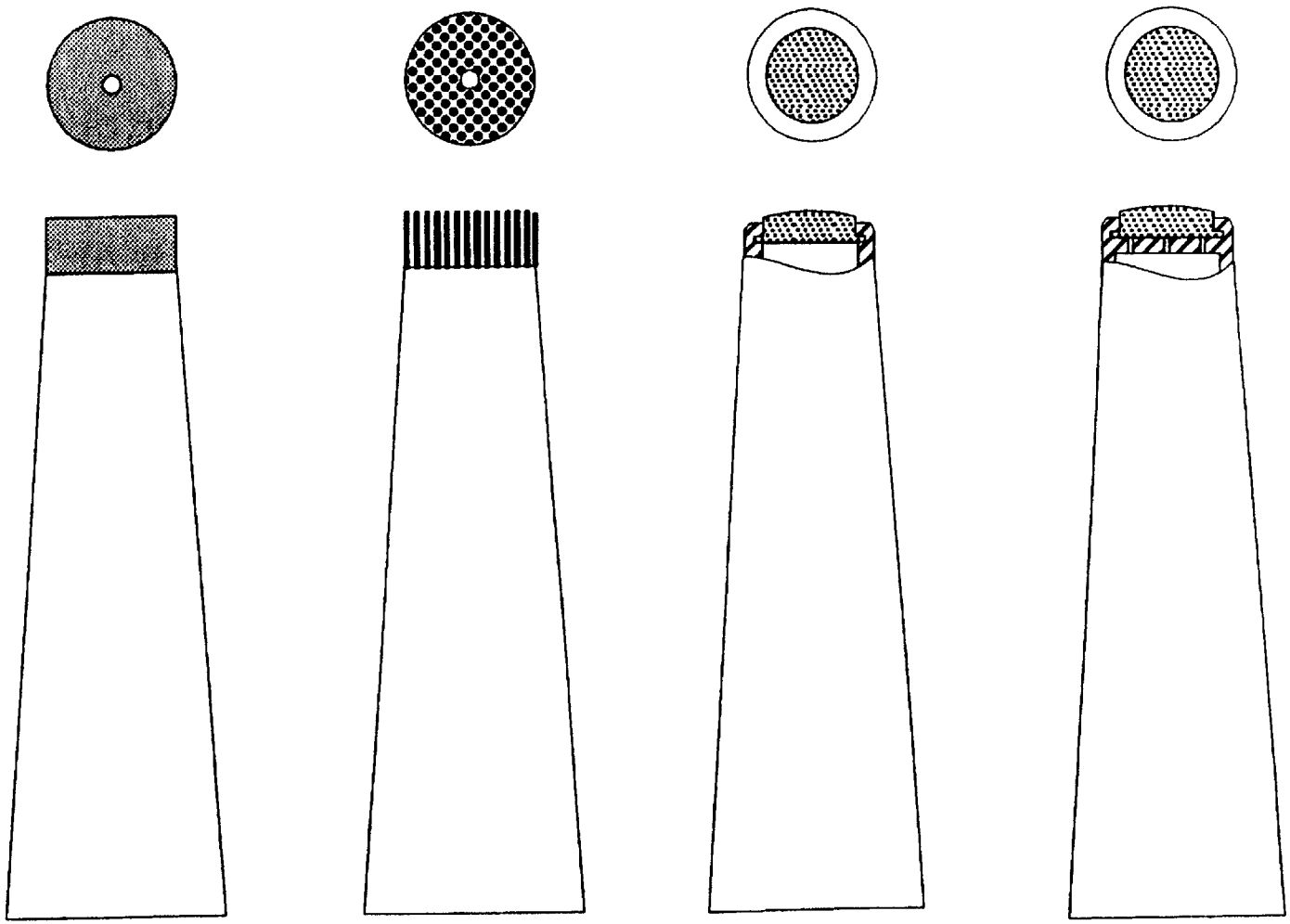
FIG. 1 shows the top and longitudinal view of a container with a foam pad secured to its cap. The cap has a small central opening through which the liquid can pass.
FIG. 2 shows the top and longitudinal view of a container with a brush secured to its cap. The cap has a small central opening through which the liquid can pass.
FIG. 3 shows the top and longitudinal view of a container with a convex shaped polypropylene porous pad. The pad has pore size ranging from 300 to 700 micrometers.
FIG. 4 shows the top and longitudinal view of a container with a convex shaped polypropylene porous pad and a supporting plate which has a plurality of holes which restricts the amount of liquid that passes through the porous material. The pad has pore size ranging from 300 to 700 micrometers.
Figure 7:
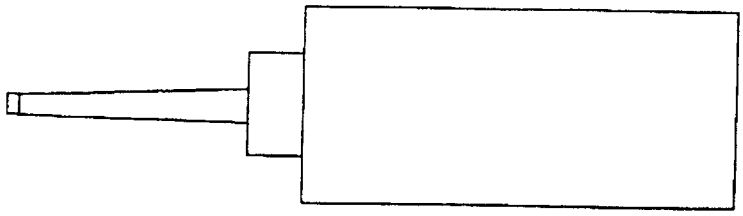
FIG. 7 shows the longitudinal view of a conventional container with an elongated extremity, used to apply liquid on surfaces.
Figure 6:
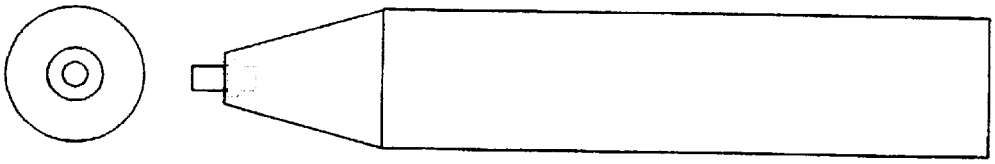
FIG. 6 shows the top and longitudinal view of a container with a piston-type extremity. Upon pressing of the tip of the piston against a fabric surface, a liquid is released from within the container onto the fabric.
Figure 5:
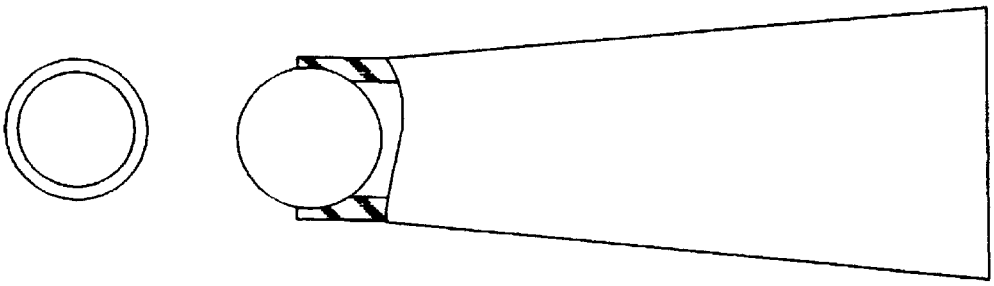
FIG. 5 shows the top and longitudinal view of a container with a roll-on type extremity.

A most preferred cleaning method comprises the steps of:

(a) applying a detergent composition to a spot or stain and placing an absorbent layer adjacent to the textile fabric in the region of the spot or stain and a first means for transferring some or all of the spot or stain into the absorbent layer; and subsequently (b) applying a hydrophilic solvent, or water, to the textile fabric in the region of the spot or stain and placing an absorbent layer adjacent to the textile fabric in the region of the spot or stain and the step of applying heat to the textile fabric in the region of the spot or stain. The application of heat or pressure, or both, may be achieved by any means, but is most preferably achieved by a hand-held device such as an iron. A conventional iron having a hot-plate fixed to a body is a highly preferred hand held device. The hot-plate is heated most commonly by electrical means, and may have a means for controlling the temperature. A supply of water or steam may also be provided by the iron. Most preferably the absorbent layer is placed on a flat surface, such as an ironing board, and the stained or soiled textile fabric is laid flat on top of, and in contact with, the absorbent layer. The iron can then be easily applied to the textile fabric in the region of the stain or spot in order to ensure complete, or substantially complete, transfer of the stain or spot into the absorbent layer. The iron is preferably operated at a temperature of from 40° C. to 180° C.

An alternative device for applying heat or pressure is a heated roller or any other heated applicator. The roller or applicator may also be provided with a supply of the detergent composition.

Suitable applicators include a steam iron with suction brush attachment, such as that disclosed in EP-A-0 493 348, and a thermoelectric applicator, such as that disclosed in EP-A-0 552 397. Also suitable is a steam iron with atomiser, such as that disclose in EP-A-0 629 736 wherein the detergent composition may optionally be stored in the iron and delivered directly onto the textile fabrics by means of the atomiser.

Without wishing to be bound by theory it is believed that hydrophobic stains are first rendered hydrophilic by applying a detergent composition, optionally with a gentle rubbing action; water is then applied to the stain, again, optionally with a gentle rubbing action. The stain is removed by laying the stained fabric adjacent to an absorbent layer. The stain, which has been rendered more hydrophilic by the treatment, is transferred to the absorbent layer.

Textile fabrics are any materials made from cloth, including garments such as shirts, blouses, socks, skirts, trousers, jackets, underwear etc, and also including tablecloths, towels, curtains etc. The definition of textile fabrics as used herein does not include carpets and similar floor coverings.

Textile fabrics which are to be used in the present invention are commonly made by weaving or knitting. Many different fibres may be used to produce woven, knitted or other types of textile fabric including synthetic fibres (such as polyester, polyamide, etc.) and natural fibres from plants (such as cotton, hemp) and from animals (such as wool, angora, silk). Blends of different fibres are also commonly used.

Preferred components of the detergent composition will now be described in more detail.

A highly preferred component of the detergent composition for use herein is a solvent. More preferred solvents are defined in terms of Hansen parameters. A hydrophobic solvent as defined herein is considered to be a solvent having Hansen hydrogen bonding cohesion parameter dH below 18 $(\text{Joule/cm}^3)^{0.5}$. Preferred hydrophobic solvents have a Hansen hydrogen bonding cohesion parameter dH below 12 $(\text{Joule/cm}^3)^{0.5}$ and a Hansen polar parameter dH below 8 $(\text{Joule/cm}^3)^{0.5}$.

Preferred solvents for use comprise mixtures of hydrocarbons with a flash point no lower than 70° C., an initial boiling point no lower than 130° C. and a solidification point not above 20° C. and aliphatic fatty acid esters. More preferred solvents would be alkanes or alkenes with a chain length above C7, and particularly alkanes and alkenes with an average of C8 to C20 atoms. Particularly preferred hydrophobic solvents are deodorised kerosine; solvent naphta; chlorinated hydrocarbons; and terpenes. Even more preferred are paraffins; isoparaffins; naphthenes; aromatics; olefins; 1,1,1-trichloroethane perchloroethylene; methylene chloride; Shellsol SS® mixture (C8–C11 isoparaffin +5% aliphatic C7 ester); and D-Limonene. Solvents are used in the detergent compositions of the present invention preferably at a level of from 3% to 90%, more preferably from 4% to 45%, and most preferably from 5% to 25% by weight of the detergent composition.

Other solvents having a Hansen parameter of dH less than 18 $(\text{Joule/cm}^3)^{0.5}$ include glycol ethers, more preferably glycol ethers based upon ethylene oxide, propylene oxide, or mixtures thereof. Particularly preferred are ethylene glycol monoethyl ether; Propylene glycol monomethyl ether; 2-butoxy ethanol; butyl diethylene glycol ether ethanol; butoxytriglycol; butylene glycol; hexylene glycol; and propyl propanol. Such solvents may, and preferably are, used in combination with either short chain surfactants, long chain surfactants, or mixtures thereof.

In one embodiment of the invention the hydrophobic solvents defined above are used in combination with mixtures of short chain and long chain surfactants having preferably an overall HLB value of from 2 to 16, and more preferably from 8 to 14. Preferred molar ratio of short-chain to long chain ratios are from 1:10 to 10:1, more preferably between 1:3 and 3:1, most preferably about 1:1.

Surfactants are preferably present at a level of from 1 to 50%, more preferably 10 to 40% and most preferably 15 to 30% by weight of the detergent composition.

Short chain surfactants are surfactants which comprise a C6–C10 alkyl chain as their hydrophobic portion. Preferred short-chain surfactants for use are the C4–C8 fatty alcohol polyglycol ethers with 2–5 EO. C6–C8 alkyl sulphonates, C6–C8 alkyl sulphates, C6–C8 alkyl ethoxy sulphates, C6–C10 betaines or C6–C10 amine oxides could also be useful.

Long-chain surfactants useful in the detergent compositions of the present invention include the following.

Water-soluble salts of the higher fatty acids, i.e., "soaps", are useful anionic surfactants in the compositions herein. This includes alkali metal soaps such as the sodium, potassium, ethanolamine, ammonium, and alkylammonium salts of higher fatty acids containing from about 8 to about 24 carbon atoms, and preferably from about 12 to about 18 carbon atoms. Soaps can be made by direct saponification of fats and oils or by the neutralization of free fatty acids. Particularly useful are the ethanolamine, sodium and potassium salts of the mixtures of fatty acids derived from coconut oil and tallow, i.e., monoethanolamine, sodium or potassium tallow and coconut soap.

Useful anionic surfactants also include the water-soluble salts, preferably the alkali metal, ethanolamine, ammonium and alkylolammonium salts, of organic sulfuric reaction products having in their molecular structure an alkyl group containing from about 10 to about 20 carbon atoms and a sulfonic acid or sulfuric acid ester group. (Included in the term "alkyl" is the alkyl portion of acyl groups.) Examples of this group of synthetic surfactants are the alkyl sulfates, especially those obtained by sulfating the higher alcohols ($C_8$–$C_{18}$ carbon atoms) such as those produced by reducing the glycerides of tallow or coconut oil; and the alkyl benzene sulfonates in which the alkyl group contains from about 9 to about 15 carbon atoms, in straight or branched chain configuration, e.g., those of the type described in U.S. Pat. Nos. 2,220,099 and 2,477,383; and methyl ester sulphonates. Especially valuable are linear straight chain alkyl benzene sulfonates in which the average number of carbon atoms in the alkyl group is from about 11 to 13, abbreviated as $C_{11}$–$C_{13}$ LAS.

Other anionic surfactants herein are the alkyl glyceryl ether sulfonates, especially those ethers of higher alcohols derived from tallow and coconut oil; coconut oil fatty acid monoglyceride sulfonates and sulfates; salts of alkyl phenol ethylene oxide ether sulfates containing from about 1 to about 10 units of ethylene oxide per molecule and wherein the alkyl groups contain from about 8 to about 12 carbon atoms; and salts of alkyl ethylene oxide ether sulfates containing from about 1 to about 10 units of ethylene oxide per molecule and wherein the alkyl group contains from about 10 to about 20 carbon atoms.

Other useful anionic surfactants herein include the water-soluble salts of esters of alpha-sulfonated fatty acids containing from about 6 to 20 carbon atoms in the fatty acid group and from about 1 to 10 carbon atoms in the ester group; water-soluble salts of 2-acyloxy-alkane-1-sulfonic acids containing from about 2 to 9 carbon atoms in the acyl group and from about 9 to about 23 carbon atoms in the alkane moiety; alkyl ether sulfates containing from about 10 to 20 carbon atoms in the alkyl group and from about 1 to 30 moles of ethylene oxide; watersoluble salts of olefin sulfonates containing from about 12 to 24 carbon atoms; and beta-alkyloxy alkane sulfonates containing from about 1 to 3 carbon atoms in the alkyl group and from about 8 to about 20 carbon atoms in the alkane moiety.

Water-soluble nonionic surfactants are also useful as surfactants in the compositions of the invention. Indeed, preferred processes use anionic/nonionic blends. Such nonionic materials include compounds produced by the condensation of alkylene oxide groups (hydrophilic in nature) with an organic hydrophobic compound, which may be aliphatic or alkyl aromatic in nature. The length of the polyoxyalkylene group which is condensed with any particular hydrophobic group can be readily adjusted to yield a water-soluble compound having the desired degree of balance between hydrophilic and hydrophobic elements.

Suitable nonionic surfactants include the polyethylene oxide condensates of alkyl phenols, e.g., the condensation products of alkyl phenols having an alkyl group containing from about 6 to 16 carbon atoms, in either a straight chain or branched chain configuration, with from about 4 to 25 moles of ethylene oxide per mole of alkyl phenol.

Preferred nonionics are the water-soluble condensation products of aliphatic alcohols containing from 8 to 22 carbon atoms, in either straight chain or branched configuration, with from 1 to 25 moles of ethylene oxide per mole of alcohol, especially 2 to 7 moles of ethylene oxide per mole of alcohol. Particularly preferred are the condensation products of alcohols having an alkyl group containing from about 9 to 15 carbon atoms; and condensation products of propylene glycol with ethylene oxide.

Other preferred nonionics are polyhydroxy fatty acid amides which may be prepared by reacting a fatty acid ester and an N-alkyl polyhydroxy amine. The preferred amine for use in the present invention is N-(R1)-CH2(CH2OH)4—CH2—OH and the preferred ester is a C12–C20 fatty acid methyl ester. Most preferred is the reaction product of N-methyl glucamine (which may be derived from glucose) with C12–C20 fatty acid methyl ester.

Methods of manufacturing polyhydroxy fatty acid amides have been described in WO 9206073, published on Apr. 16, 1992. This application describes the preparation of polyhydroxy fatty acid amides in the presence of solvents. In a highly preferred embodiment of the invention N-methyl glucamine is reacted with a C12–C20 methyl ester.

Semi-polar nonionic surfactants include water-soluble amine oxides containing one alkyl moiety of from about 10 to 18 carbon atoms and 2 moieties selected from the group consisting of alkyl groups and hydroxyalkyl groups containing from 1 to about 3 carbon atoms; water-soluble phosphine oxides containing one alkyl moiety of about 10 to 18 carbon atoms and 2 moieties selected from the group consisting of alkyl groups and hydroxyalkyl groups containing from about 1 to 3 carbon atoms; and water-soluble sulfoxides containing one alkyl moiety of from about 10 to 18 carbon atoms and a moiety selected from the group consisting of alkyl and hydroxyalkyl moieties of from about 1 to 3 carbon atoms.

Ampholytic surfactants include derivatives of aliphatic or aliphatic derivatives of heterocyclic secondary and tertiary amines in which the aliphatic moiety can be either straight or branched chain and wherein one of the aliphatic substituents contains from about 8 to 18 carbon atoms and at least one aliphatic substituent contains an anionic water-solubilizing group.

Zwitterionic surfactants include derivatives of aliphatic quaternary ammonium phosphonium, and sulfonium compounds in which one of the aliphatic substituents contains from about 8 to 18 carbon atoms.

Useful cationic surfactants include water-soluble quaternary ammonium compounds of the form $R_4R_5R_6R_7N^+X^-$, wherein $R_4$ is alkyl having from 10 to 20, preferably from 12–18 carbon atoms, and $R_5$, $R_6$ and $R_7$ are each $C_1$ to $C_7$ alkyl preferably methyl; $X^-$ is an anion, e.g. chloride. Examples of such trimethyl ammonium compounds include $C_{12-14}$ alkyl trimethyl ammonium chloride and cocalkyl trimethyl ammonium methosulfate.

Other surfactants that may be used in the compositions of the present invention include C10–C18 glycerol ethers, C10–18 alkyl polyglycoside and their corresponding sulphated polyglycosides, alkyl ester sulphonates, and oleoyl sarcosinate.

Enzymes can also be incorporated into the composition of the present invention.

The composition of the present invention can contain neutral or alkaline salts which have a pH in solution of seven or greater, and can be either organic or inorganic in nature. While some of the salts are inert, many of them also function as detergency builder materials in the laundering solution.

Examples of neutral water-soluble salts include the alkali metal, ethanolamine, ammonium or substituted ammonium chlorides, fluorides and sulfates. The sodium, ethanolamine and ammonium salts of the above are preferred. Citric acid and, in general, any other organic or inorganic acid may be incorporated into the present invention.

Other useful water-soluble salts include the compounds commonly known as detergent builder materials. Builders are generally selected from the various water-soluble, alkali metal, ethanolamine, ammonium or substituted ammonium phosphates, polyphosphates, phosphonates, polyphosphonates, carbonates, silicates, borates, and polyhydroxysulfonates. Preferred are the sodium, ethanolamine and ammonium salts of the above.

Specific examples of inorganic phosphate builders are sodium and potassium tripolyphosphate, pyrophosphate, polymeric metaphosphate having a degree of polymerization of from about 6 to 21, and orthophosphate. Examples of polyphosphonate builders are the salts of ethylene diphosphonic acid, the salts of ethane 1-hydroxy-1,1-diphosphonic acid and the salts of ethane, 1,1,2-triphosphonic acid. Other phosphorus builder compounds are disclosed in U.S. Pat. Nos. 3,159,581; 3,213,030; 3,422,021; 3,422,137; 3,400,176 and 3,400,148, incorporated herein by reference. In general, however, phosphates are preferably avoided for environmental reasons.

Examples of nonphosphorus, inorganic builders are sodium and potassium carbonate, bicarbonate, sesquicarbonate, tetraborate decahydrate, and silicate having a molar ratio of $SiO_2$ to alkali metal oxide of from about 0.5 to about 4.0, preferably from about 1.0 to about 2.4.

It is preferred that the detergent composition used herein is in liquid form, comprising active components selected from those described above, the balance of the detergent composition, typically from 5t to 92% by weight, consisting of water. The preferred viscosity of the detergent composition is from 1 to 10000 mpa.s, more preferably from 1 to 4000 mpa.s, and most preferably from 1 to 300 mpa.s.

Hydrophilic solvents for use herein are considered to be those solvents having a Hansen parameter of either dH more than 18 $(\text{Joule/cm}^3)^{0.5}$, or dP more than 8 $(\text{Joule/cm}^3)^{0.5}$.

Preferred hydrophilic solvents are: water (including aqueous solutions); alcohol (ethanol, IPA); glycol ethers including diethylene glycol, triethylene glycol and ethylene glycol; ethylene cyanohydrin; ethanol amine and triethanolamine.

Bleaching agents may also be useful in the method of the present invention for treating bleachable stains. The bleaching agents may be incorporated into the compositions described above, or may be added as separate bleaching compositions. Peroxide bleaching agents are most preferred.

Absorbent Layers

As used herein, the term "absorbent layers" refers to materials which absorb and contain fluids.

The absorbent layer may be any absorbent means which is generally compressible, conformable, and capable of absorbing and retaining liquids. The absorbent pad may be manufactured in a wide variety of sizes and shapes (e.g., rectangular, round, asymmetric, etc.). Examples of suitable absorbent materials include comminuted wood pulp, creped cellulose wadding; meltblown polymers; chemically stiffened, modified or cross-linked cellulosic fibers; tissue including tissue wraps and tissue laminates; absorbent foams; absorbent sponges; superabsorbent polymers; absorbent gelling materials; or any equivalent material or combinations of materials. The configuration and construction of the absorbent pad may also be varied (e.g., the absorbent pad may have varying caliper zones, a hydrophilic gradient, a superabsorbent gradient, or lower average density and lower average basis weight acquisition zones; or may comprise one or more layers or structures). Further, the size and absorbent capacity of the absorbent pad may be varied.

Optionally, the absorbent layer can include a backsheet which can be either liquid permeable (poly film) or not (e.g. non-woven, too).If the backsheet is a poly film, the following applies: The poly backsheet is positioned on the bottom surface of the absorbent pad and is preferably joined thereto by attachment means such as those well known from the manufacture of disposable articles. For example, the backsheet may be secured to the absorbent pad by a uniform continuous layer of adhesive, a patterned layer of adhesive, or an array of separate lines, spirals, or spots of adhesive.

Adhesives which have been found to be satisfactory are manufactured by H. B. Fuller Company of St. Paul, Minn. and marketed as HL-1258. The attachment means will preferably comprise an open pattern network of filaments of adhesive as is disclosed in U.S. Pat. No. 4,573,986 entitled "Disposable Waste-Containment Garment", which issued to Minetola et al. on Mar. 4, 1986, more preferably several lines of adhesive filaments swirled into a spiral pattern such as is illustrated by the apparatus and methods shown in U.S. Pat. No. 3,911,173 issued to Sprague, Jr. on Oct. 7, 1975; U.S. Pat. No. 4,785,996 issued to Ziecker, et al. on Nov. 22, 1978; and U.S. Pat. No. 4,842,666 issued to Werenicz on Jun. 27, 1989. Alternatively, the attachment means may comprise heat bonds, pressure bonds, ultrasonic bonds, dynamic mechanical bonds, or any other suitable attachment means or combinations of these attachment means as are known in the art.

The backsheet is impervious to liquids and is preferably manufactured from a thin, heat resistant, plastic film, although other flexible liquid impervious materials may also be used. The backsheet prevents the liquids absorbed and contained in the absorbent pad from wetting underlying materials. The backsheet may thus comprise a woven or nonwoven material, polymeric films such as thermoplastic films of polyethylene or polypropylene, or composite materials such as a film-coated nonwoven material.

Optionally, the absorbent layer may include a topsheet or outer, protective layer. The topsheet is liquid pervious permitting liquids to readily penetrate through its thickness. Preferably, the characteristics of this outer protective layer includes that it be of appropriate design to substantially prevent loss or transfer of fibers of the inner sorbent material outwardly there through, that it preferably possesses sufficient heat transfer or heat sink characteristics, to inhibit transfer of sufficient heat through to the inner sorbent material to cause substantial melting thereof; and, that it be relatively stable to heat from contact with a hot domestic iron or the like A suitable topsheet may be manufactured from a wide range of materials, such as porous foams; reticulated foams; apertured plastic films; or woven or nonwoven webs of natural fibers (e.g., wood or cotton fibers), synthetic fibers (e.g., polyester or polypropylene fibers), or a combination of natural and synthetic fibers. There are a number of manufacturing techniques which may be used to manufacture this topsheet. For example, it may be a nonwoven web of fibers spunbonded, carded, wet-laid, meltblown, hydroentangled, combinations of the above, or the like. A preferred topsheet is carded and thermally bonded by means well known to those skilled in the fabrics art. A preferred topsheet comprises a web of staple length polypropylene fibers such as is manufactured by Veratec, Inc., a Division of International Paper Company, of Walpole, Mass. under the designatiion P-8.

Another usable non woven material is manufactured from Crown Zellerbach of Camas, under the trade name Celestra.

The absorbent structure is located between the topsheet and the backsheet, and might comprise these two as in integral element. It can be produced from a wide variety of liquid-absorbent materials, such as also commonly used in disposable hygienic articles, such as diapers, catamenials or Adult incontinence articles.

Exemplary absorbent structures for use as absorbent layer as used in the disposable industry are described in U.S. Pat. No. 4,610,678 entitled "High-Density Absorbent Structures" issued to Weisman et al. on Sep. 9, 1986; U.S. Pat. No. 4,673,402 entitled "Absorbent Articles With Dual-Layered Cores" issued to Weisman et al. on Jun. 16, 1987; U.S. Pat. No. 4,888,231 entitled "Absorbent Core Having A Dusting Layer" issued to Angstadt on Dec. 19, 1989; and U.S. Pat. No. 4,834,735, entitled "High Density Absorbent Members Having Lower Density and Lower Basis Weight Acquisition Zones", issued to Alemany et al. on May 30, 1989. Other absorbent pad designs are described in European Patent Application No.'s 93305150.0 and 93309614.1.

Exemplary designs comprise the use of fibrous (e.g. cellulosic) materials in combination with "Superabsorbent materials", essentially hydrogel forming materials. Absorbent gelling materials are extensively used in absorbent hygiene articles such as diapers or sanitary napkins, due to their high absorption capacity for liquids, which may typically range from 15 g per gram to about 50 g/g. The gelling material is most often applied in particulate form in particle sizes ranging from 20 to 2000 micrometers.

EP-A-0 407 838 discloses a gel-forming material for use in foodstuffs, which comprises a mixture of a crosslinked polymer and a non-crosslinked polymer for lump-free solution in water.

EP-A-0 278 601 discloses a mixture of an absorbent gelling polymer, such as formed from water-soluble, ethylenically unsaturated monomers or crosslinked products thereof, including acrylic acid or a salt of acrylic acid as the main component, and inorganic material such as aluminia, or silica. The polymers in the mixture may be comprised of any combination of two or more chemically different types. The disclosed absorbent mixture is suited to absorb both low-viscosity and high-viscosity liquids.

WO 91/12029 discloses an odor control composition comprising aggregated absorbent gelling material particles and zeolite material. The absorbent gelling material is made of hydrolized acrylonitrile grafted starch, acrylic acid grafted starch, polyacrylates, malice anhydride-based copolymers and combinations thereof.

U.S. Pat. No. 4,333,464 discloses a sanitary napkin having water absorbent polymer which may comprise a mixture of two types of absorbent gelling material from the group consisting of starch, β-hydroxyethylacrylate, acrylonitrile, acrylic acid and acrylamide, carboxymethylcellulose, hydrophilic copolymers of acrylates, copolymers of a vinyl ester and an ethylenically unsaturated carboxylic acid and their saponification products, polyvinyl alcohol, and its derivatives.

U.S. Pat. No. 4,902,544 discloses a flexible tubular casing comprising a crosslinked hydrocolloid and naturally occurring cellulose such as saw dust, crushed corncobs, cottonlinters, wood pulp and the like, ion-exchange resins or clay minerals.

GB-B-1 544 002 discloses a mixture of a salt of an acrylic acid polymer and either guar gum, alginates or xanthan gum to provide an absorbent material with good absorbent properties, irrespective of the presence of an electrolyte in the liquid to be absorbed. Polyvalent ions may be incorporated in the absorbent composite.

U.S. Pat. No. 4,411,660 discloses in an absorbent product two layers of absorbent material of different types, such that the upper layer gels slower than the first layer.

European Patent Specification EP-B-0 401 189 discloses that favourable properties of absorbent products can be achieved by using two different types of absorbent gelling material in separate layers, rather than as a mixture of the two absorbent gelling materials in a single layer.

The hydrogel-forming absorbent polymers useful in the present invention include a variety of substantially water-insoluble, but water-swellable polymers capable of absorbing large quantities of liquids. Such polymers materials are also commonly referred to as "hydrocolloids", or "superabsorbent" materials. These hydrogel-forming absorbent polymers preferably have a multiplicity of anionic, functional groups, such as sulfonic acid, and more typically carboxy, groups. Examples of polymers suitable for use herein include those which are prepared from polymerizable, unsaturated, acid-containing monomers. Thus, such monomers include the olefinically unsaturated acids and anhydrides that contain at least one carbon to carbon olefinic double bond. More specifically, these monomers can be selected from olefinically unsaturated carboxylic acids and acid anhydrides, olefinically unsaturated sulfonic acids, and mixtures thereof.

Some non-acid monomers can also be included, usually in minor amounts, in preparing the hydrogel-forming absorbent polymers herein. Such non-acid monomers can include, for example, the water-soluble or water-dispersible esters of the acid-containing monomers, as well as monomers that contain no carboxylic or sulfonic acid groups at all. Optional non-acid monomers can thus include monomers containing the following types of functional groups: carboxylic acid or sulfonic acid esters, hydroxyl groups, amide-groups, amino groups, nitrile groups and quaternary ammonium salt groups. These non-acid monomers are well-known materials and are described in greater detail, for example, in U.S. Pat. No. 4,076,663 (Masuda et al), issued Feb. 28, 1978, and in U.S. Pat. No. 4,062,817 (Westerman), issued Dec. 13, 1977, both of which are incorporated by reference.

Olefinically unsaturated carboxylic acid and carboxylic acid anhydride monomers include the acrylic acids typified by acrylic acid itself, methacrylic acid, ethacrylic acid, -chloroacrylic acid, a-cyanoacrylic acid, -methylacrylic acid (crotonic acid), -phenylacrylic acid, -acryloxypropionic acid, sorbic acid, -chlorosorbic acid, angelic acid, cinnamic acid, p-chlorocinnamic acid, -sterylacrylic acid, itaconic acid, citroconic acid, mesaconic acid, glutaconic acid, aconitic acid, maleic acid, fumaric acid, tricarboxyethylene and maleic acid anhydride.

Olefinically unsaturated sulfonic acid monomers include aliphatic or aromatic vinyl sulfonic acids such as vinylsulfonic acid, alkyl sulfonic acid, vinyl toluene sulfonic acid and styrene sulfonic acid; acrylic and methacrylic sulfonic acid such as sulfoethyl acrylate, sulfoethyl methacrylate, sulfopropyl acrylate, sulfopropyl methacrylate, 2-hydroxy-3-methacryloxypropyl sulfonic acid and 2-acrylamide-2-methylpropane sulfonic acid.

Preferred hydrogel-forming absorbent polymers for use in the present invention contain carboxy groups. These polymers include hydrolyzed starch-acrylonitrile graft copolymers, partially neutralized starch-acrylonitrile graft copolymers, starch-acrylic acid graft copolymers, partially neutralized starch-acrylic acid graft copolymers, saponified vinyl acetate-acrylic ester copolymers, hydrolyzed acrylonitrile or acrylamide copolymers, slightly network crosslinked polymers of any of the foregoing copolymers, partially neutralized polyacrylic acid, and slightly network crosslinked polymers of partially neutralized polyacrylic acid. These polymers can be used either solely or in the form of a mixture of two or more different polymers. Examples of these polymer materials are disclosed in U.S. Pat. No.

3,661,875, U.S. Pat. No. 4,076,663, U.S. Pat. No. 4,093,776, U.S. Pat. No. 4,666,983, and U.S. Pat. No. 4,734,478.

Most preferred polymer materials for use in making hydrogel-forming particles are slightly network crosslinked polymers of partially neutralized polyacrylic acids and starch derivatives thereof. Most preferably, the hydrogel-forming particles comprise from about 50 to about 95%, preferably about 75%, neutralized, slightly network crosslinked, polyacrylic acid (i.e. poly (sodium acrylate/acrylic acid)).

As described above, the hydrogel-forming absorbent polymers are preferably slightly network crosslinked. Network crosslinking serves to render the polymer substantially water-insoluble and, in part, determines the absorptive capacity and extractable polymer content characteristics of the precursor particles and the resultant macrostructures. Processes for network crosslinking the polymers and typical network crosslinking agents are described in greater detail in the hereinbefore-referenced U.S. Pat. No. 4,076,663, and in DE-A-4020780 (Dahmen).

Although the hydrogel-forming absorbent polymers can have a size varying over a wide range, specific particle size distributions and sizes are preferred. For purposes of the present invention, particle size is defined for hydrogel-forming absorbent polymers that do not have a large greatest dimension/smallest dimension ratio such as fibers (e.g., granules, flakes, or pulverulents) as the dimension of a precursor particle that is determined by sieve size analysis. Thus, for example, a hydrogel-forming absorbent polymer particle that is retained on a standard #30 sieve with 600 micron openings is considered to have a particle size greater than 600 microns, a hydrogel-forming absorbent polymer particle that passes through the #30 sieve with 600 micron openings and is retained on a standard #35 sieve with 500 micron openings is considered to have a particle size between 500 and 600 microns, and a hydrogel-forming absorbent polymer particle that passes through a #35 sieve with 500 micron openings is considered to have a particle size less than 500 microns. For preferred hydrogel-forming absorbent polymers useful in the present invention, the particles will generally range in size from about 1 micron to about 2000 microns, more preferably from about 20 microns to about 1000 microns.

Further, for purposes of this invention, the mass median particle size of the hydrogel-forming absorbent polymers is important in determining the characteristics and properties of the resultant particles. The mass median particle size of a given sample of hydrogel-forming absorbent polymer particles is defined as the particle size that divides a sample in half on a mass basis. Instead of the mass median particle size, the mass average particle size could be specified as a measure for the dimension of the particles, wherein the mass average particle size is the average particle size of the sample on a mass basis. A method for determining the mass median particle size of a sample is described hereinafter in the Test Methods section. The mass median particle size of the hydrogel-forming absorbent polymer particles will generally be from about 20 microns to about 1500 microns, more preferably from about 50 microns to about 1000 microns. For preferred hydrogel-forming absorbent polymers useful in the present invention, the particles have a mass median particle size less than about 1000 microns, more preferably less than about 600 microns, most preferably less than about 500 microns.

The particle size of materials having a large greatest dimension/smallest dimension such as fibers is typically defined by their largest dimension. For example, if hydrogel-forming absorbent polymeric fibers are used in the present invention, the length of the fibers is used to define the "particle size." (The denier and/or the diameter of the fibers can also be specified.) For exemplary embodiments of hydrogel-forming absorbent polymers useful in the present invention, the fibers have a length greater than about 5 mm, preferably between about 10 mm and about 100 mm, more preferably between about 10 mm and about 50 mm.

Preferred hydrogel-forming absorbent polymer particles of the present invention are those which exhibit a high absorptive capacity or Teabag Centrifuge Capacity value. Absorptive capacity, or Teabag Centrifuge Capacity, refers to the capacity of a given polymer to absorb liquids with which it comes into contact under free-swelling conditions. TCC can vary significantly with the nature of the liquid being absorbed and with the manner in which the liquid contacts the polymer material. For purposes of the present invention, Teabag Centrifuge Capacity is defined in terms of the amount of 0.9% saline solution absorbed by any given polymer in terms of grams of saline solution per gram of polymer material in a Tea bag Centrifuge Capacity test procedure hereinafter defined in the Test Methods section. Preferred hydrogel-forming absorbent polymer particles of the present invention are those which have Teabag Centrifuge Capacity values of at least about 20 grams, more preferably at least about 25 grams, of saline solution per gram of polymer material. Typically, the hydrogel-forming absorbent polymer particles useful herein have Teabag Centrifuge Capacity values of from about 20 grams to about 70 grams of saline solution per gram of polymer. Mixtures of hydrogel-forming absorbent polymers particles having this relatively high absorptive capacity characteristic are especially useful in the present invention since the resultant absorbent member formed from such particles can, by definition, hold desirably high amounts of fluid.

Other Absorbent structures for current absorbent pads can use of particulate Superabsorbent materials as described above, but forming a coherent structure from these. Such "Porous, absorbent polymeric macrostructures and methods of making same" are described in U.S. Pat. No. 5,124,188/WO 91/15362 assigned to Roe et al.

Alternatively, Superabsorbent highly absorbent foam materials suitable for use in current invention are described in U.S. Pat. Nos. 5,328,935 and 5,338,766, assigned to Trokhan and Phan.

Alternatively, "Absorbent Foam Materials for aqueous body fluids and absorbent articles containing such materials" as described in U.S. Pat. No. 5,268,224 assigned to DesMarais et al. are suitable for current application, too Optionally, the absorbent structure may include some specialized materials developed to absorb oils and greases. One example of this is T-151 oil sorbent, a 3M product, (Minnesota Mining and Manufacturing, ST. Paul, Minn.), T-151 absorbent and similar absorbent materials are typically non-woven polymeric fiber webs and include certain polyolefin polymers such as polypropylene, polyethylene, poly-4-methylpentene, arylene, styrene, and copolymers thereof, as well as polyesters, polyamides, and polycarbonates.

Methods

Teabag Centrifuge Capacity Test

The Teabag Centrifuge Capacity test measures the Teabag Centrifuge Capacity values, which are a measure of the retention of liquids in the gelling material at hydrostatic pressure The superabsorbent material is placed within a "teabag", immersed in a 0.9% by weight sodium chloride solution for 20 minutes, and then centrifuged for 3 minutes. The ratio of the retained liquid weight to the initial weight of the dry superabsorbent material is the absorptive capacity of the superabsorbent material.

21 of 0.9% by weight sodium chloride in distilled water is poured into a tray having dimensions 24 cm×30 cm×5 cm. The liquid filling height should be about 3 cm.

The teabag pouch has dimensions 6.5 cm×6.5 cm and is available from a company called Teekanne in Düsseldorf, Germany. The pouch is heat sealable with a standard kitchen plastic bag sealing device (e.g. VACUPACK$_2$ PLUS from Krups, Germany).

The teabag is opened by carefully cutting it partially, and is then weighed. A 0.200 g +/− 0.005 g sample of the superabsorbent material is placed in the teabag. The teabag is then closed with a heat sealer. This is called the sample teabag.

An empty teabag is sealed and used as a blank.

Each teabag is then held horizontally, and the sample teabag is shaken so as to distribute the superabsorbent material evenly throughout the bag. The sample teabag and the blank teabag are then laid on the surface of the saline solution, and submerged for about 5 seconds using a spatular to allow complete wetting (the teabags will float on the surface of the saline solution but are completely wetted). The timer is started immediately.

After 20 minutes soaking time the sample teabag and the blank teabag are removed from the saline solution, and placed in a Bauknecht WS130, Bosch 772 NZK096 or equivalent centrifuge (230 mm diameter), so that each bag sticks to the outer wall of the centrifuge basket. The centrifuge lid is closed, the centrifuge is started, and the speed increased quickly to 1,400 rpm . Once the centrifuge has been stabilised at 1,400 rpm the timer is started. After 3 minutes, the centrifuge is stopped.

The sample teabag and the blank teabag are removed and weighed separately.

The Teabag Centrifuge Capacity (TCC) for the sample of superabsorbent hydrogel-forming material is calculated as follows:

$$TCC = [(\text{sample teabag weight after centrifuging}) - (\text{blank teabag weight after centrifuging}) - (\text{dry superabsorbent hydrogel-forming material weight})] + (\text{dry superabsorbent material weight}).$$

Mass Median Particle Size Determination

The particle size distribution of superabsorbent material is determined by placing a known weight of a sample in a Retsch mechanical sieving device, and shaking for a specified period of time under defined conditions. Sample sections that are retained on each sieve and the bottom pan are weighed and reported as percentages of the original sample weight.

100 g +/− 0.5 g of dry superabsorbent polymeric material is weighed into a sample sup which is then closed by a lid.

Four sieves are nested from bottom to top as follows: stainless steel bottom pan, No. 325, No. 100, No. 50 and No. 20; these being numbers of the U.S. sieve series (ASTM-E-11-61). The sample is transferred to the upper most of the series of sieves, and the powder is distributed evenly around the screen. A stainless steel cover is places on the No. 20 sieve.

The nested sieves are placed in position on a Retsch testing sieve shaker Vibotronic Type VE1 with timer. It is ensured that the Retsch lid fits a s tightly as possible against the top of the shaker. The timer is set for 10 minutes, and started to begin the test. When the shaker has stopped, the nest of sieves is removed from the shaker.

Each of the sieve fractions retained by the sieve is then weighed, for example by different measurements, to the nearest 0.0 g.

It is important to work quickly in this test to avoid moisture pickup by the superabsorbent material.

The mass median particle size of a given sample of hydrogel-forming absorbent polymer particles is defined as the particle size that divides the sample in half on a mass basis, i.e., one-half of the sample by weight will have a particle size less than the mass median size and one-half of the sample will have a particle size greater than the mass median size. A standard particle-size plotting method (wherein the cumulative weight percent of the particle sample retained on or passed through a given sieve size opening is plotted versus sieve size opening on probability paper) is typically used to determine mass median particle size when the 50% mass value does not correspond to the size opening of a U.S.A. Standard Testing Sieve. These methods for determining particle sizes of the hydrogel-forming absorbent polymer particles are further described in U.S. Pat. No. 5,061,259 (Goldman et. al), issued Oct. 29, 1991, which is incorporated by reference.

EXAMPLES

In the examples, all compositions are expressed as % by weight (unless otherwise stated).

Examples 1 to 78

| Compositions | Ex. 1 | Ex. 2 | Ex. 3 | Ex. 4 |
|---|---|---|---|---|
| Limonene | 18.3 | 36 | 23.5 | |
| Shellsol ® | | | | 23.5 |
| Monoethanol Amine | 3 | | 5.8 | 5.8 |
| HLAS | 16.5 | | | |
| Butyl carbitol | 10 | 18 | 11.7 | 11.7 |
| Oleic Acid | | 9 | 6 | 6 |
| Alkyl sulphate C8AS | | 10 | 7.8 | 7.8 |
| Water | Balance | Balance | Balance | Balance |

| Compositions | Ex. 5 | Ex. 6 | Ex. 7 | Ex. 8 |
|---|---|---|---|---|
| Shellsol ® | 20 | 60 | 25 | |
| Ethylene glycol monobutyl ether | | | 15 | 7 |
| Trichloroethylene | | | | 5 |
| Sodium lauryl sulphate | | | 15 | 5 |
| Alkyl sulphate C8AS | 4 | | | |
| Dehydol C8EO4 ® | 3 | 5 | | |
| Dobanol 25C3 ® | 3 | 10 | | |
| Water | Balance | Balance | Balance | Balance |

In Table 1, Shellsol® is a mixture of C8-C11 isoparaffins with 5% aliphatic C7 ester. Dehydol® is a fatty alcohol polyglycol ether octyl 4EO, supplied by Henkel. Dobanol® is a ethoxylated primary alcohol 3EO supplied by Shell.

A set of polycotton swatches (50 mm square) were soiled with make-up, chocolate sauce and tomato sauce. The stain was left to age for a day, in the dark, at normal room temperature (c.a. 20° C., 60% RH). Each soiled swatch was cleaned by the following method:

1. The stained area was placed directly upon a strip of absorbent paper (the paper used was the absorbent core of a diaper).

2. 1 ml of the composition of Example 1 was dripped on to the stained area.
3. The stained area was brushed with a conventional electrical toothbrush for 10 seconds (the toothbrush used, a Braun® dental d3, was one normally intended for daily oral care).
4. The steps 2. and 3. were repeated one more time.
5. 1 ml of distilled water was dripped on to the stained area, and pressure and heat were applied using an iron set at a temperature of 120° C. for 10 seconds. A typical ironing pressure, as normally used for removing wrinkles in fabrics, was used.
6. Step 5. was repeated with a further 2 ml of distilled water.
7. The swatch was dried and smoothed.

The method of cleaning was repeated on stained swatches using the compositions of Examples 2 to 78 in place of the composition of Example 1.

| Ingredient | Ex. 9 | Ex. 10 | Ex. 11 | Ex. 12 | Ex. 13 |
|---|---|---|---|---|---|
| Perchlorethylene | 99.693 | 95.8 | 95 | 84.25 | 59.23 |
| MEA-LAS[1] | 0.3 | | | | 40 |
| Sodium Dodecyl sulphate | | | 0.03 | 0.0047 | |
| Sodium Dioctyl sulfo-succinate | | 3.2 | | | |
| Nonyl Phenol ethoxylate 8 EO | | | 4.97 | 0.7455 | |
| Isopropanol | 0.005 | | | | |
| Ethylene glycol mono-butyl ether | | | | | 0.5 |
| Brightener | 0.0002 | | | | 0.02 |
| Water | | Balance | | | Balance |

[1]Monoethanol amine salt of linear alkyl benzene sulphonic acid

| Ingredient | Ex. 14 | Ex. 15 | Ex. 16 | Ex. 17 | Ex. 18 |
|---|---|---|---|---|---|
| Perchlorethylene | 40 | 20 | | | |
| Stoddard solvent | | | 95 | | |
| Ethylene glycol mono-butyl ether | | 5 | | 5 | 25 |
| Octyl phenol ethoxylate EO 7–8 | 50 | 10 | | | |
| Nonyl phenol ethoxylate EO 6 | | | 5 | | |
| Isopropyl dodecyl-benzene sulphonate | | 5 | | | 50 |
| Coconut diethanolamide | | | | 1 | |
| Isopropyl alcohol | 5 | | | 25 | |
| Mineral spirits | | | | 69 | |
| Mineral Oil | | | | | 24 |
| Optical brightener | | | | | 1 |
| Perfume | 0.1 | 0.1 | | | |
| Water | Balance | Balance | — | — | — |

| Ingredient | Ex. 19 |
|---|---|
| Butoxy propoxy propanol | 7 |
| 1,2 octanediol | 0.5 |
| Pemulen TR-1 (emulsifier from Goodrich) | 0.15 |
| KOH | 0.08 |
| Perfume | 0.75 |
| Water | Balance pH = 6.5 |

| Ingredient | Ex. 20 | Ex. 21 |
|---|---|---|
| Shellsol SS | 33 | 10 |
| C12–C15 alkyl ethoxylate EO 3 | 16 | 6 |
| C12–C15 alkyl ethoxylate EO '9 | 16 | 6 |
| Isopropyl alcohol | 13 | 13 |
| Oleic fatty acid | 6 | 2 |
| Triethanolamine | 3 | 1.05 |

-continued

| | | | | | |
|---|---|---|---|---|---|
| Sodium xylene sulfonate | | | | | 2.4 |
| Water | | | Balance | | Balance |

| Ingredient | Ex. 22 | Ex. 23 | Ex. 24 | Ex. 25 | Ex. 26 |
|---|---|---|---|---|---|
| Sodium dodecyl sulphate | 15 | | | | |
| Sodium Hexadecyl sulphate | | 15 | | | |
| Nonyl phenol ethoxylate EO 9 | | | 40 | | |
| Octyl phenol ethoxylate EO 6 | | | | 40 | |
| Octyl phenol ethoxylate EO 3 | | | | | 15 |
| Pentanol | 55 | 50 | 40 | 40 | 55 |
| Water | Balance | Balance | Balance | Balance | Balance |

| Ingredient | Ex. 27 | Ex. 28 | Ex. 29 |
|---|---|---|---|
| Shellsol SS | 25 | | |
| High flash Naphta* | | 50 | 10 |
| Kerosene | | | 30 |
| Sodium dodecyl sulphate | 16 | | |
| Ammonium dodecanoxy-polyethlenoxy ethyl sufate | | 36 | 40 |
| mono-butyl ether of ethylene glycol | 20 | | 2.5 |
| Perfume | 0.2 | 0.2 | 0.2 |
| Water | Balance | Balance | Balance |

*Hi-flash Naphta, a mixture of saturated hydrocarbon from Amsco Company

| Ingredient | Ex. 30 | Ex. 31 | Ex. 32 |
|---|---|---|---|
| Cyclohexanol | 7 | 6 | 5 |
| isopropanol | | 2 | 2.5 |
| toluene | 20 | 20 | 15 |
| 1,2 dichloroethane | 18 | 20 | 6 |
| 1,1,1 trichloroethane | 45 | 40 | 65 |
| Water | Balance | Balance | Balance |

| Ingredient | Ex. 33 | Ex. 34 | Ex. 35 | Ex. 36 |
|---|---|---|---|---|
| Citric acid | 5 | 5 | 16.1 | 3.57 |
| NaOH | 3.1 | 3.1 | 10 | 2.21 |
| Sodium dioctyl sulphosuccinate | 6 | 6 | 1.6 | 4.28 |
| Nonylnonoxylnol-7 phosphate | | 2 | 1.6 | 1.42 |
| Isopar K[1] | 20 | 20 | 16 | 42.85 |
| Sorbitan ester (monooleate) | | 0.6 | 0.48 | 0.42 |
| Polyethylene sorbitan ester (monooleate) | | 1.4 | 1.12 | 1 |
| Limonene | 1 | 1 | 1 | 0.71 |
| Water | Balance | Balance | Balance | Balance |

[1]C10–C12 isoparaffinic hydrocarbon, from Exxon

| Ingredient | Ex. 37 | Ex. 38 | Ex. 39 | Ex. 40 | Ex. 41 |
|---|---|---|---|---|---|
| LAS | | | 0.32 | | |
| Coconut alkyl sulphate | | | | | 5.28 |
| C12–C14 alkyl ethoxy-late EO 7 | | | | | 6.32 |
| C13–C15 alkyl ethoxy-late EO 7 | 7.84 | 7.47 | 35.88 | 23 | |
| Fatty acid | 0 | | | 6.2 | 0.16 |
| Citric acid | 1.03 | | | | |
| IPA | | | 5 | | |
| Paraffin C9–C12 | | 40 | 47.24 | | |
| Water | Balance | Balance | Balance | Balance | Balance |

| Ingredient | Ex. 42 | Ex. 43 | Ex. 44 | Ex. 45 | Ex. 46 |
|---|---|---|---|---|---|
| C13–C15 alkyl ethoxy-late EO 3 | 12 | | 1 | | |
| C13–C15 alkyl ethoxy-late EO 7 | 3 | | 5 | | |
| C8 alkyl sulphate | | | 10 | 14 | 14 |
| C8 alkyl sulphonate | 9 | 20 | | | |
| C7–C9 alkyl ethoxy- | | | 5 | | |

-continued

| | | | | | |
|---|---|---|---|---|---|
| late EO 6 | | | | | |
| C8 alkyl ethoxylate EO 4 | | | | | |
| C8–C10 alkyl ethoxylate EO 5 | | 20 | 9 | | |
| C8–C10 alkyl ethoxylate EO 6 | | | | 20 | 20 |
| C12–C13 alkyl ethoxylate EO 3 | | | | 6 | 8 |
| C13–C15 alkyl ethoxylate EO 30 | 6 | | 5 | | |
| Citric acid | 6 | | 3 | 12 | 12 |
| Monoethanolamine | | 1 | | | |
| Triethanolamine | 3 | | | | |
| Diethylene Glycol Monobutyl ether | | | | 6 | 30 |
| Potassium carbonate | | | | 4 | 4 |
| Palm Kernel Fatty acid | 1.2 | | | 1 | 1 |
| 2-Butyl octanol | | | | 1 | 1 |
| Water and minors | Balance | Balance | Balance | Balance | Balance |

| Ingredient | Ex. 47 | Ex. 48 | Ex. 49 | Ex. 50 |
|---|---|---|---|---|
| C10 alkyl sulphate | 1.2 | | | |
| C12–C14 alkyl sulphate | | | | 0.5 |
| C13–C15 EO 30 | | | 0.75 | |
| C12–C13 EO 6.5 | | | 0.9 | |
| C12–C13 EO 3 | 1 | | 1 | |
| C14–C15 EO 7 | | | | |
| C9–C11 EO 10 | 1.6 | | 2.6 | |
| Phosphonate | 0.18 | | | 0.3 |
| PVP | 0.2 | | | |
| Hydrogen Peroxide | 6.8 | | 7 | 6 |
| Chlorine | | 5 | | |
| Sulphuric Acid | 0.013 | | 0.013 | |
| NaOH | | 1.4 | | |
| Na2CO3 | | 1.25 | | |
| Na2SiO3 | | 0.5 | | |
| Isofol 12 | 0.49 | | | |
| 2 Hexyl decanol | | | 0.3 | |
| MA/AA[1] | | | | 1 |
| Isopropyl alcohol | | | | 5 |
| Optical brightener | 0.04 | | 0.06 | |
| Dye | 0.0006 | | 0.0006 | |
| Perfume | 0.25 | | | |
| Water | Balance pH = 4 | Balance | Balance | Balance |

[1]MA/AA = Acrylic maleic based copolymers, MW of 70000, the ratio of acrylate to maleate segments vary from 10:1 to 2:1. Sokalan CP5 from BASF

| Ingredient | Ex. 51 | Ex. 52 | Ex. 53 |
|---|---|---|---|
| C12 dimethyl amine oxide | 1 | 1 | 1.8 |
| C8 alkyl sulphate | 4 | 8 | 1 |
| polyacrylate (polygel DK), thickener | | 1.5 | |
| C12 fatty acid (thickener) | | | 0.8 |
| Sodium benzoate | | 0.5 | |
| NaOH up to pH | 12–13 | 12–13 | 12–13 |
| Water | Balance | Balance | Balance |

| Ingredient | Ex. 54 | Ex. 55 | Ex. 56 |
|---|---|---|---|
| C14–C17 alkyl sulphonate | 27 | 20 | 35 |
| C12–C15 alkyl ether sulphate (EO 3) | 4 | 5 | 8.5 |
| C9–C11 alkyl ethoxylate EO 8 | 5.4 | | 11 |
| C8–C18 alkyl sulphate | 4 | | 1.85 |
| Water | Balance | Balance | Balance |

| Ingredient | Ex. 57 | Ex. 58 | Ex. 59 |
|---|---|---|---|
| 3-(N-dodecyl-N-N-dimethyl)-2-hydroxy-propane-1 sulfonate | 2 | 10 | |
| C9–C11 alkyl ethoxylate EO 2.5 | 1.1 | 5 | |
| C9–C11 alkyl ethoxylate EO 6 | 2.9 | 15 | |
| C9–C11 alkyl ethoxylate EO 8 | | | 3 |
| Butoxy Propoxy Propanol | 5 | 25 | |
| Oxydisuccinic acid | 10 | 10 | |
| Sodium cumene sulfonate | 4.2 | 20 | |

-continued

| | | | |
|---|---|---|---|
| Maleic acid | | | 20 |
| Water | Balance | Balance | Balance pH = 1 |

| Ingredient | Ex. 60 | Ex. 61 |
|---|---|---|
| C12–C13 EO 6.5 | 2.5 | 25 |
| Dipropylene Glycol Monbutyl Ether | 3 | 30 |
| Monoethanolamine | 0.5 | 5 |
| Sodium Dodecylbenzene sulfonate | 0.5 | 3 |
| Coconut Fatty acid | 0.03 | 3 |
| Water | Balance | Balance |

| Ingredient | Ex. 62 | Ex. 63 |
|---|---|---|
| Sodium Lauryl Sulphate | 12.6 | 12.6 |
| Isopropanol | 3 | 16.5 |
| Propylene Glycol Methyl Ether | 2 | |
| Amyl Acetate | 0.25 | 0.3 |
| Monopotassium Phosphate | 0.9 | 0.9 |
| Methylene chloride | | 5 |
| Sodium EDTA | | 0.05 |
| Water | Balance | Balance |

| Ingredient | Ex. 64 | Ex. 65 | Ex. 66 | Ex. 67 | Ex. 68 |
|---|---|---|---|---|---|
| Hexane | | 67 | | | |
| Decane | 25 | | 32.5 | | |
| Dodecane | | | | 2.5 | 10 |
| C12–C15 alkyl ethoxylate EO 9 | 20 | | | | |
| C14–C15 alkyl ethoxylate EO 8 | | 20 | | | |
| C12–C13 alkyl ethoxylate EO 5.5 | | | 35 | | |
| C16–C18 alkyl ethoxylate EO 9 | | | | 12.5 | 40 |
| Ethylene glycol | 55 | 13 | | 81 | 47.5 |
| Glycerol | | | | 4 | 2.5 |
| PEG 300 | | | 32.5 | | |

| Ingredient | Ex. 69 | Ex. 70 | Ex. 71 |
|---|---|---|---|
| Sodium 2,6,9 trioxa-12 hexyleicosyl sulphate | 6.4 | | |
| Sodium dodecylbenzene sulphonoate | | 11.7 | 11.7 |
| Butanol | 4.1 | 7.3 | 7.3 |
| NaCl | 4.4 | 2.9 | 2.9 |
| Kerosene | | 8.5 | |
| isoparaffinic hydrocarbon | 6.2 | | |
| pine oil | | | 8.5 |
| Water | Balance | Balance | Balance |

| Ingredient | Ex. 72 | Ex. 73 |
|---|---|---|
| C14–C15 alkyl ethoxylate EO 2.25 sulphate | 18 | 9 |
| C12–C13 alkyl ethoxylate EO 6.5 | 2 | 1 |
| C12–C14 N-methylglucamide | 6 | 3 |
| Citric acid | 4 | 2 |
| C12–C14 fatty acid | 2 | 1 |
| Ethanol | 4 | 2 |
| 1,2 propanediol | 7 | 3.5 |
| Monoethnolamine | 1 | 0.5 |
| Optical brightener | 0.1 | |
| Soil release polymer[1] | 0.3 | 0.15 |
| Boric acid | 2.5 | 1.25 |
| Protease | 1.4 | 0.7 |
| Lipase | 0.18 | 0.09 |
| Polyethylene glycol (MW 4000) | 1.5 | 0.75 |
| Polyaspartic acid (MW 10,000) | 0.5 | 0.25 |
| NaOH | up to pH = 10 | up to pH = 10 |
| Water | Balance | Balance |

[1]Ethoxylated copolymer of polyethylene-polypropylene terephthalate polysulfonic acid

| Ingredient | Ex. 74 | Ex. 75 | Ex. 76 | Ex. 77 | Ex. 78 |
|---|---|---|---|---|---|

-continued

| | | | | | |
|---|---|---|---|---|---|
| Alkyl sulphate | 16.75 | 1.6 | | 4.48 | |
| Alkyl ethoxy sulphate | 2 | 0.2 | | 13.58 | |
| LAS | | | | | 7.57 |
| C12–C15 alkyl ethoxylate EO 7 | 5.5 | 0.55 | 10 | | 5.61 |
| C12–C18 N-methylglucamide | 5.5 | 0.55 | | | |
| Citric acid | 1 | 0.1 | 16.8 | 0.63 | 1.56 |
| Fatty acid | 10.5 | 1.05 | 2.9 | 13.67 | |
| Carbonate | | | 1.2 | | |
| Propanediol | 11.5 | 1.15 | | 6.97 | |
| Ethanol | 1.4 | 0.14 | | 5.08 | |
| PEG 200–300 | | | 35 | | |
| Glycerine | | | | | 4.54 |
| MEA | 7.8 | 0.78 | | | |
| NaOH | 1.2 | 0.12 | | | |
| Phosphonate | 1 | 0.01 | 0.5 | | 0.21 |
| Zeolite | | | | | 28.01 |
| Ethoxylated tetraethylenpentamine | 0.25 | 0.025 | | | |
| Soil release polymer | 0.15 | 0.015 | | | |
| CMC | | | 1 | | |
| Protease | 0.5 | 0.05 | 0.5 | | |
| Lipolase | 0.07 | 0.007 | | | |
| Amylase | 0.15 | 0.015 | 0.18 | | |
| Cellulase | 0.03 | 0.003 | | | |
| CaC12 | 0.02 | 0.002 | | | |
| Boric acid | 3.5 | 0.35 | | | |
| Silicone oil | 0.2 | | | | |
| Dispersant | 0.02 | | | | |
| Silica | 0.013 | | | | |
| Propyl trimethoxysilane | 0.02 | | | | |
| Optical brightener | 0.15 | 0.0147 | | | |
| Dye | 0.001 | | | | |
| PB1 | | | 13 | | |
| PB4 | | | | | 2 |
| Water | Balance pH = 8.5 | Balance | Balance | Balance | Balance |

Example 79

A set of wool, polycotton and cotton swatches (50 mm square) were soiled with honey, salad dressing and tomato sauce. The stain was left to age for a day, in the dark, at normal room temperature (c.a. 20° C., 60% RH). Each soiled swatch was cleaned by the following method.

1. The stained area was placed directly upon a strip of absorbent paper (the paper used was the absorbent core of a diaper).
2. 1 ml of the composition of Example 74 was applied on to the stained area by means of an applicator of design indicated in FIG. 1. This applicator comprised a bottle, a cap with a pad of polyurethane foam attached to it. The cap has a small central opening through which the liquid can pass.

After application of the detergent composition, the stain was massaged with the outer surface of the pad to loosen it.

3. 1 ml of distilled water was sprayed on the stained area, and pressure and heat were applied using an iron set at a temperature of 80° C. for 15 seconds. A typical ironing pressure, as normally used for removing wrinkles in fabrics, was used.
4. Step 3. was repeated with a further 2 ml of distilled water.
5. The swatch was then dried and smoothed.

The method of cleaning was repeated on stained swatches using the applicator of FIGS. 2 to 7 in place of the applicator of FIG. 1.

The method of cleaning was repeated on polycotton swatches stained with dirty motor oil using the applicator of FIG. 4 in place of the applicator of FIG. 1 and the cleaning composition of example 5 in place of the composition of example 74.

Examples 80 to 93

A set of cotton swatches (50 mm square) were soiled with lipstick and clay. The stain was left to age for a day, in the dark, at normal room temperature (c.a. 20° C., 60% RH). Each soiled swatch was, cleaned by the following method.

1. The stained area was placed directly upon a strip of absorbent paper (the paper used was the absorbent core of a diaper).
2. 1 ml of the composition of Example 6 was applied on to the stained area by means of an applicator of a design indicated in FIG. 7. After application of the detergent composition, the stain was massaged with the tip of the cleansing bottle to loosen it.
3. 1 ml of the composition of Example 80 was sprayed on the stained area, and pressure and heat were applied using an iron set at a temperature of 100° C. for 15 seconds. A typical ironing pressure, as normally used for removing wrinkles in fabrics, was used.
4. Step 3 was repeated with a further 2 ml of distilled water.
5. The swatch was then dried and smoothed.

The method of cleaning was repeated on stained swatches using the applicator of examples 81 to 93 in place of the composition of example 80.

| Ingredient | Ex. 80 | Ex. 81 |
|---|---|---|
| Isopropyl alcohol | 18 | 10 |
| C8 Alkyl phenol ethoxylate EO 7–8 | 0.5 | |
| C8–C18 alkyl ethoxylate EO 7–8 | | 0.5 |
| Citric acid | 3 | |
| Amonium Hydroxide | 2 | |
| Mazawet DF wetting agent (from Mazer) | | 0.2 |
| Masil 1066c emulsion[1] | | 0.2 |
| Coconut amine | | 0.4 |
| Water | Balance | Balance |

[1]Specialty silicone fluid from Mazer

| Ingredient | Ex. 82 | Ex. 83 | Ex. 84 | Ex. 85 | Ex. 86 |
|---|---|---|---|---|---|
| Isopropyl alcohol | 15 | 5 | 50 | 35 | 8 |
| methanol | | | 47 | | |
| Diethylene glycol monomethylether | | | | 7.5 | |
| Ethylene glycol n-butyl ether | | | | | 1 |
| C12–15 alkyl ethoxylate EO 6.5 | 0.1 | | | | |
| Nonyl phenol ethoxylate EO 9 | | | | 0.5 | |
| Ammonium ethoxysulphate (Nedodol 25-3a) | | 0.15 | | | |
| Triton QS-30[1] | | | 0.5 | | |
| Capryloampho-diacetate[2] | | | | | 0.3 |
| Ammonium hydroxide | | 0.15 | 1 | | |
| Water | Balance | Balance | Balance | Balance | Balance |

[1]Phosphate ester
[2]Wetting agent

| Ingredient | Ex. 87 | Ex. 88 | Ex. 89 | Ex. 90 |
|---|---|---|---|---|
| Octyl phenol ethoxylate EO 5 | 20 | | | 5 |
| Octyl phenol ethoxylate E9–10 | | | | 2.5 |
| Octyl phenol ethoxylate EO 12–13 | | 5 | 5 | |

-continued

| | | | | |
|---|---|---|---|---|
| C12–C14 alkyl sulphate | 10 | | | |
| Triton H66[1] | | 7.5 | 7.5 | 2 |
| Dipropylene glycol methyl ether | | 4 | 4 | 6 |
| Phosphonate | | 2 | | |
| Citric acid | | 15 | | 3 |
| Pine oil | | | | 0.25 |
| Water | Balance | Balance | Balance | Balance |

[1]Potassium phosphate ester from Rohm and Haas

| Ingredient | Ex. 91 | Ex. 92 | Ex. 93 |
|---|---|---|---|
| C10 alkyl sulphate | 1.2 | | |
| C12–C14 alkyl sulphate | | | 0.5 |
| C13–C15 EO 30 | | 0.75 | |
| C12–C13 EO 6.5 | | 0.9 | |
| C12–C13 EO 3 | 1 | 1 | |
| C14–C15 EO 7 | | | |
| C9–C11 EO 10 | 1.6 | 2.6 | |
| Phosphonate | 0.18 | | 0.3 |
| PVP | 0.2 | | |
| Isofol 12 | 0.49 | | |
| 2 Hexyl decanol | | 0.3 | |
| MA/AA[1] | | | 1 |
| Isopropyl alcohol | | | 5 |
| Water and minors | Balance | Balance | Balance |

[1]MA/AA = Acrylic maleic based copolymers, MW of 70000, the ratio of acrylate to maleate segments vary from 10:1 to 2:1. Sokalan CP5 from BASF Example 94

A set of silk and wool swatches (50 mm square) were soiled with make-up and tomato sauce. The stain was left to age for a day, in the dark, at normal room temperature (c.a. 20° C., 60% RH). Each soiled swatch was cleaned by the following method.

1. The stained area was placed directly upon a strip of absorbent paper (the paper used was the absorbent core of a diaper).
2. A non-linting sheet is prepared using a non-woven, two-ply fabric stock comprising polyester fibres, calliper 0.25 to 0.34 mm, basis weight 84 g/m$^2$. The fabric is cut into a 100 cm$^2$ sheet, 10 cm on a side. 10 g of the composition of example 19 are applied by dipping the composition onto the substrate, followed by squeezing with a roller.

This sheet is placed on top of the soiled area. The area of overlap between the paper and the soil is brushed with a toothbrush for 10 seconds. A typical pressure as normally used to clean teeth was used. After brushing the paper is discarded.

3. 1 ml of water was sprayed on the stained area, and pressure and heat were applied using an iron set at a temperature of 40° C. for 15 seconds. A typical ironing pressure, as normally used for removing wrinkles in fabrics, was used.
4. Step 3. was repeated with a further 2 ml of water.
5. The swatch was then dried and smoothed.

In an alternate mode, the soiled area was pretreated by pressing or rubbing with a sheet prepared according to the instructions given here above. After pretreatment with the cleaning sheet, the stained area was cleaned with the iron in the manner described in steps 3, 4 and 5 herein. In this mode of application, during the rubbing stage, the stain is pushed through the fabric onto the underlying absorbent paper.

Example 95

A set of silk and wool swatches (50 mm square) were soiled with make-up and tomato sauce. The stain was left to age for a day, in the dark, at normal room temperature (c.a. 20° C., 60% RH). Each soiled swatch was cleaned by the following method.

1. The stained area was placed directly upon a strip of absorbent paper (the paper used was a sheet of kitchen paper towel).
2. A non-linting sheet is prepared using a non-woven, two-ply fabric stock comprising polyester fibres, calliper 0.25 to 0.34 mm, basis weight 84 g/m$^2$. The fabric is cut into a 100 cm$^2$ sheet, 10 cm on a side. 10 g of the composition of example 19 are applied by dipping the composition onto the substrate, followed by squeezing with a roller.

This sheet is placed on top of the soiled area. The soiled area sandwiched between the paper towel and the cleaning sheet was inserted between the clips of the device of a design given in FIG. 8. The body of the device is made of plastic, a pad of polyurethane foam is attached on each side of the clip.

After insertion of the sheet/soil/absorbent paper assembly within the clips. The gap between the sponges is closed by applying pressure to the connecting means as indicated by the arrow, thereby causing the sponges to contact with the cleaning sheet and the paper towel. The tool thus designed allows pushing of the stain through the fabric onto the underlying absorbent paper without any damage to the fabric.

3. 1 ml of water was sprayed on the stained area, and pressure and heat were applied using an iron set at a temperature of 40° C. for 15 seconds. A typical ironing pressure, as normally used for removing wrinkles in fabrics, was used.
4. Step 3. was repeated with a further 2 ml of water.
5. The swatch was then dried and smoothed.

Figure 9:
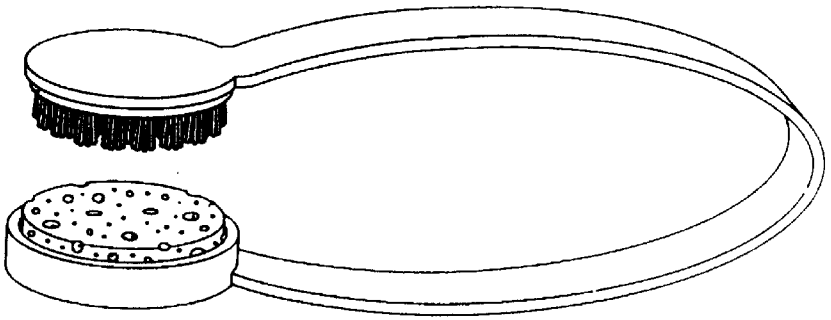
FIG. 9 shows a hand-operated device having a bristled protuberances comprising the first treatment member and a disposable sponge as a second treatment member.
Figure 8:
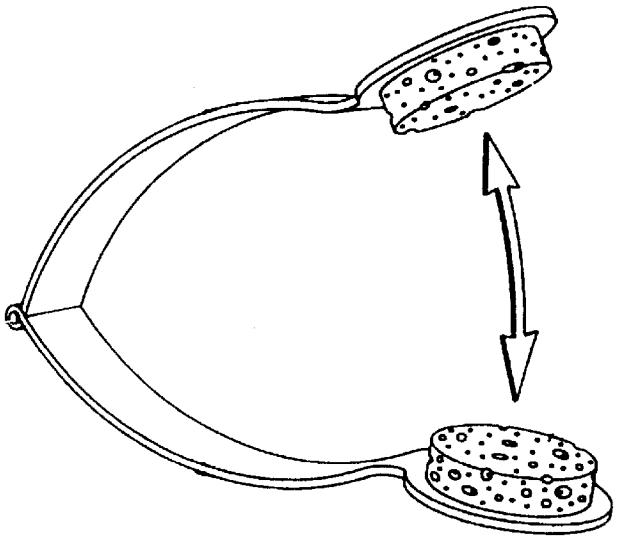
FIG. 8 shows a hand-operated device having sponge-type first and second treatment members.

The method of cleaning was repeated on stained swatches using the spot cleaning device of FIG. 9 in place of the spot cleaning device of FIG. 8.

Example 96

A set of polycotton swatches (50 mm square) were soiled with make-up, chocolate sauce and tomato sauce. The stain was left to age for a day, in the dark, at normal room temperature (c.a. 20° C., 60% RH). Each soiled swatch was cleaned by the following method:

1. The stained area was placed directly upon a strip of absorbent paper (the paper used was the absorbent core of a diaper).
2. 1 ml of the composition of Example 1 was dripped on to the stained area.
3. The stained area was brushed with a dual-temperature cordless massager from Ultratherm®, model TM2000.
4. The steps 2. and 3. were repeated one more time.
5. 1 ml of distilled water was dripped on to the stained area, and pressure and heat were applied using an iron set at a temperature of 120° C. for 10 seconds. A typical ironing pressure, as normally used for removing wrinkles in fabrics, was used.
6. Step 5. was repeated with a further 2 ml of distilled water.
7. The swatch was dried and smoothed.

The method of cleaning was repeated on stained swatches using the compositions of Examples 2 to 5, and 19 in place of the composition of Example 1.

Example 97

A set of polycotton swatches (50 mm square) were soiled with make-up, chocolate sauce and tomato sauce. The stain was left to age for a day, in the dark, at normal room temperature (c.a. 20° C., 60% RH). Each soiled swatch was cleaned by the following method:

1. The stained area was placed directly upon a strip of absorbent paper (the paper used was the absorbent core of a diaper).
2. 1 ml of composition of example 19 was dripped on to the stained area, and pressure and heat were applied using an iron (Braun® Saphir 7000) set at a temperature of 100° C. for 10 seconds. A typical ironing pressure, as normally used for removing wrinkles in fabrics, was used.
3. The steps 2. and 3. were repeated one more time.
4. 1 ml of distilled water was dripped on to the stained area, and pressure and heat were applied using an iron set at a temperature of 120° C. for 10 seconds. A typical ironing pressure, as normally used for removing wrinkles in fabrics; was used.
5. Step 4. was repeated with a further 2 ml of distilled water.
6. The swatch was dried and smoothed.

The method of cleaning was repeated on stained swatches using the compositions of Examples 1 to 8, and in place of the composition of Example 19.

Example 98

A set of silk and wool swatches (50 mm square) were soiled with make-up, chocolate sauce and tomato sauce. The stain was left to age for a day, in the dark, at normal room temperature (c.a. 20° C., 60% RH). Each soiled swatch was cleaned by the following method:

1. The stained area was placed directly upon a strip of absorbent paper (the paper used was the absorbent core of a diaper).
2. The water tank of a Rowenta® Steam Brush DA55 was filled with the composition of Example 19. The appliance was placed over the stained area, and 1 ml of the detergent composition was steamed on to it.
3. 1 ml of the detergent composition was steamed over the soiled area. At the same time, the soiled area was brushed with the cloth brush attached to the head of the appliance.
4. The steps 2. and 3. were repeated one more time.
5. 1 ml of distilled water was dripped on to the stained area, and pressure and heat were applied using an iron set at a temperature of 120° C. for 10 seconds. A typical ironing pressure, as normally used for removing wrinkles in fabrics, was used.
6. Step 5. was repeated with a further 2 ml of distilled water.
7. The swatch was dried and smoothed.

In an alternate mode, after the pretreament with the detergent composition indicated in steps 2, 3 and 4 herein. The water tank was emptied of the detergent composition and filled with distilled water. 1 ml of distilled water was then dripped on to the stained area, and pressure and heat were applied using the Rowenta® Steam Brush DA55.

Example 99

A set of silk and wool swatches (50 mm square) were soiled with make-up and tomato sauce. The stain was left to age for a day, in the dark, at normal room temperature (c.a. 20° C., 60% RH). Each soiled swatch was cleaned by the following method.

1. A non-linting sheet is prepared using a non-woven, two-ply fabric stock comprising polyester fibres, calliper 0.25 to 0.34 mm, basis weight 84 g/m$^2$. The fabric is cut into a 100 cm$^2$ sheet, 10 cm on a side. 10 g of the composition of example 19 are applied by dipping the composition onto the substrate, followed by squeezing with a roller.

Figure 10:
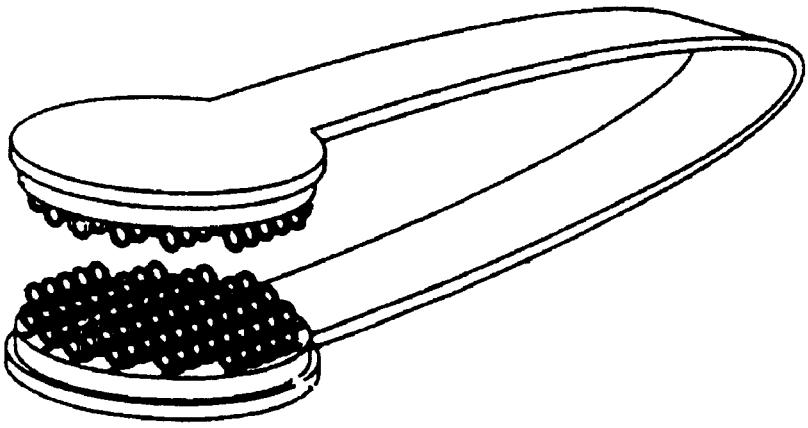
FIG. 10 shows a hand-operated device with the first and second treatment members comprising looped protuberances.

A hand-held spot removal device as shown in FIG. 10 is prepared using conventional plastic injection molding techniques and apparatus. The arms which comprise the connecting means are fashioned from polypropylene, about (0.48 cm) in thickness. The connecting means may each have a uniform width of about (1.9 cm), or can be shaped to provide a more aesthetically pleasing aspect by gently narrowing the connecting means to a width of about (1.27 cm) at the bend shown in the Figure. The overall length of the device is about (13.34 cm).

The diameter of the base of each treatment member is about (3.33 cm) and the diameter of the region of the looped protrusions extending outwardly from each treatment member is about (2.86 cm).

Due to the angle of the bend between the arms of the connecting means and the resiliency of the polypropylene, the gap between the first and second treatment members is about (1.59 cm) when the device is at rest. When squeezed by hand pressure, the gap is easily closed such that the protrusions which extend from each treatment members are brought into contact with opposite sides of the stains on the fabrics being treated.

With respect to the multiple protusions which comprise the first and second treatment member, in this device the protrusions comprise stiff, looped monofilament fibers which extend from the face of each treatment member for a distance of about 2.0 mm.

The soiled area is moistened with cleaning composition by gently dabbing it with a sheet article of the foregoing type. Once moist, a device of the type shown in FIG. 10 is placed at the stained area, with the treatment members on either side of the fabric area of staining. The device is squeezed 10–30 times, slowly, to bring the illustrated looped protuberances into close contact with the fabric, thereby loosening the stain without damaging the fabric surface. The area is then again padded with the sheet article.

2. The stained area was then placed directly upon a slip of absorbent paper (the paper used was a sheet of kitchen paper towel).
3. 1 ml of water was sprayed on the stained area, and pressure and heat were applied using an iron set at a temperature of 40° C. for 15 seconds. A typical ironing pressure, as normally used for removing wrinkles in fabrics, was used.
4. Step 3 was repeated with a further 2 ml of water.
5. The swatch was then dried and smoothed.

The method of cleaning was repeated on stained swatches using the spot cleaning device of FIG. 8 to 9 in place of the spot cleaning device of FIG. 10.

What is claimed is:

1. A method for treating a spot or stain on a textile fabric comprising the steps of:

applying a detergent composition to the spot or stain;

placing an absorbent layer adjacent to one side of the textile fabric in the region of the spot or stain; and applying heat and pressure to the opposing side of the textile fabric with an iron, heated roller, or a heated applicator, in the region of the spot or stain so that some or all of the spot or stain is absorbed into the absorbent layer.

2. A method according to claim 1 wherein the step of applying both heat and pressure to the textile fabric in the region of the spot or stain also comprises the step of applying a hydrophilic solvent, or water to the textile fabric in the region of the spot or stain.

3. A method according to claim 1 wherein the detergent composition comprises a hydrophobic solvent.

4. A method according to claim 3 wherein the hydrophobic solvent is selected from the group consisting of aliphatic, cyclo-aliphatic, halogen-substituted aliphatic, aromatic hydrocarbons, isoparaffin, terpenes and mixtures thereof.

5. A method according to claim 3 wherein the detergent composition further comprises surfactant a having a carbon chain length of from C4 to C10, and surfactant a having a carbon chain length of C12 to C20.

6. A method according to claim 3 wherein the detergent composition comprises:

a) from 3 to 90% by weight of hydrophobic solvent;

b) from 5 to 50% by weight of surfactant; and c) from 5% to 92% by weight of water.

* * * * *